US009278550B2

(12) United States Patent
Matsuhashi

(10) Patent No.: US 9,278,550 B2
(45) Date of Patent: Mar. 8, 2016

(54) RECORDING APPARATUS

(71) Applicant: SEIKO EPSON CORPORATION, Tokyo (JP)

(72) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/541,551

(22) Filed: Nov. 14, 2014

(65) Prior Publication Data

US 2015/0138290 A1 May 21, 2015

(30) Foreign Application Priority Data

Nov. 20, 2013 (JP) ..... 2013-239670

(51) Int. Cl.
*B41J 11/00* (2006.01)
*B41J 11/04* (2006.01)
*B41J 15/02* (2006.01)

(52) U.S. Cl.
CPC ..... *B41J 11/002* (2013.01); *B41J 11/04* (2013.01); *B41J 15/02* (2013.01)

(58) Field of Classification Search
CPC ..... B41J 29/02; B41J 11/002
See application file for complete search history.

(56) References Cited

U.S. PATENT DOCUMENTS 6,276,793 B1 * 8/2001 Kazakos et al. ..... 347/102
2009/0214282 A1 8/2009 Koike et al.

FOREIGN PATENT DOCUMENTS

JP 10-086472 4/1998
JP 2003-094615 4/2003
JP 2009-227466 10/2009

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A recording apparatus includes a transport drum that supports and transports a recording medium on an outer peripheral surface thereof, a recording head that is provided in a position so as to be capable of facing the outer peripheral surface and ejects ink onto the recording medium, and a drying unit that is provided in the inside of the transport drum and dries the ink.

7 Claims, 4 Drawing Sheets

RECORDING APPARATUS

BACKGROUND

1. Technical Field

The present invention relates to a recording apparatus including a transport drum that supports and transports a roll-shaped recording medium on an outer peripheral surface thereof.

2. Related Art

In the related art, a recording apparatus including a drying unit that dries a transport drum supporting and transporting a recording medium on an outer peripheral surface thereof has been used. Among these, for example, as recording apparatuses disclosed in JP-A-10-86472, JP-A-2003-94615, and JP-A-2009-227466, a recording apparatus including a transport drum that supports and transports a roll-shaped recording medium on an outer peripheral surface thereof has been used.

On the other hand, since the recording speed of a recent recording apparatus has become fast, a recording apparatus including a drying unit has been used so as to promote drying of ink ejected from a recording head onto a recording medium.

A recording apparatus including a transport drum that supports and transports a recording medium on an outer peripheral surface thereof is easily enlarged. For this reason, in order to miniaturize the above described recording apparatus, for example, effective use of an inside of the transport drum is considered.

However, as disclosed in JP-A-10-86472, in the recording apparatus of the related art including the transport drum that supports and transports the recording medium on the outer peripheral surface thereof, it cannot be said that the inside of the transport drum has been effectively used.

In addition, in JP-A-2003-94615 and JP-A-2009-227466, there are no descriptions about a drying unit that dries ink recorded on a recording medium, and it is not disclosed and suggested that a space is effectively used by disposing the drying unit in the inside of the transport drum in the recording apparatus.

SUMMARY

An advantage of some aspects of the present invention is to effectively use the inside of a transport drum, in a recording apparatus including a transport drum that supports and transports a recording medium on an outer peripheral surface thereof, and a drying unit that dries ink recorded on the recording medium.

A recording apparatus according to an aspect of the invention includes a transport drum that supports and transports a recording medium on an outer peripheral surface thereof, a recording head that is provided in a position so as to be capable of facing the outer peripheral surface and ejects ink onto the recording medium, and a drying unit that is provided in the inside of the transport drum and dries the ink.

In this case, the drying unit is included in the inside of the transport drum. For this reason, a space of the inside of the transport drum can be effectively used.

In addition, since the recording head is provided on the outside (a position facing the outer peripheral surface) of the transport drum, and the drying unit that dries the ink is included in the inside of the transport drum, it is easy to divide a space into a recording space including the recording head and a drying space including the drying unit. Accordingly, while influence of the drying unit on the recording head is suppressed, the recording can be performed on the recording medium.

In the recording apparatus, the recording medium may be a recording medium capable of being wound in a roll shape, and the transport drum may include in the inside thereof a setting unit that sets the recording medium and a winding unit that winds the recording medium, and on the outer peripheral surface of the transport drum, a discharging unit that discharges the recording medium set by the setting unit to the outer peripheral surface, and an inserting unit that inserts the recording medium discharged from the discharging unit and transported along the outer peripheral surface.

In order to improve the image quality of a recording image, so-called multipath recording is generally performed in which the recording image is recorded by dividing the image into multiple images. In the recording apparatus including the transport drum that supports and transports the roll-shaped recording medium on the outer peripheral surface, when recording the recording image by dividing the image into multiple images, it is efficient that the transport drum is rotated multiple times and thus the image is recorded by dividing the image into multiple images. However, the recording apparatus including the transport drum that supports and transports the roll-shaped recording medium on the outer peripheral surface in the related art, is not configured to have a configuration in which the transport drum can be rotated multiple times and thus the image can be recorded by dividing the image into multiple images.

In this case, the transport drum includes the setting unit and the winding unit in the inside thereof, and the discharging unit and the inserting unit of the recording medium on the outer peripheral surface. Accordingly, the transport drum can be rotated multiple times in a state in which the recording medium discharged from the discharging unit and transported along the outer peripheral surface is supported as it is (in a state in which the recording medium is pulled along the outer peripheral surface). That is, the recording can be performed multiple times by rotating the transport drum multiple times.

In the recording apparatus, at least a part of at least one of bottom surfaces of the transport drum may be opened to the outside.

In this case, at least a part of at least one of the bottom surfaces of the transport drum is opened to the outside. For this reason, steam generated from a component contained ink when the drying unit dries the ink can be efficiently released to the outside, thereby making it possible to improve drying efficiency of the ink.

The recording apparatus may further include, a maintenance unit of the recording head at a position so as to be capable of facing the recording head between the discharging unit and the inserting unit provided on the outer peripheral surface.

Here, "The maintenance unit of the recording head" is not particularly limited as long as the performance of the recording head is maintained, examples thereof include a flushing box, a wiping member, an absorption member, and the like.

In this case, the maintenance unit is included at a position between the discharging unit and the inserting unit provided on the outer peripheral surface. For this reason, even in a state in which the recording medium during recording or the like is pulled along the outer peripheral surface (in a state of being supported), the recording head and the maintenance unit can face each other, and the recording head can be maintained.

The recording apparatus may further include according to the invention, a base body section that is separately provided from the transport drum, holds a member disposed in the inside of the transport drum, and is rotated with the transport drum.

Regarding to the outer peripheral surface of the transport drum which is a support surface supporting the recording medium, it is preferable that the surface not be influenced by vibration due to the rotation of the transport drum as much as possible. In this case, the base body section is separately provided from the transport drum and is rotated with the outer peripheral section. For this reason, the member disposed in the inside of the transport drum is maintained on the base body section, thereby making it possible to lighten the weight of the transport drum. In addition, transferring vibration or the like generated from the member which is disposed in the inside, directly, to the transport drum can be reduced. Accordingly, an influence of the vibration a deviation and on the recording medium which is supported on the outer peripheral surface is suppressed, due to the rotation when the member in the inside of the transport drum is not symmetric with respect to the rotating shaft. That is, while the influence of the vibration or the like due to the rotation of the transport drum is suppressed, the transport drum can be rotated multiple times and a recording can be performed multiple times on the recording medium supported on the outer peripheral surface.

In the recording apparatus, the rotating shaft of the transport drum may extend in a vertical direction.

Here, "the vertical direction" is not limited to a vertical direction in a strict sense, and it may also mean a direction which is slightly deviated from the vertical direction.

In this case, in the recording apparatus having a configuration in which the rotating shaft of the transport drum extends in a vertical direction, the inside of the transport drum can be effectively used and the ink can be dried while the influence of the drying unit on the recording head is suppressed.

In the recording apparatus, a friction coefficient between the recording medium and the outer peripheral surface may be smaller than a friction coefficient between the recording medium and the discharging unit, and a friction coefficient between the recording medium and the inserting unit.

Here, "the friction coefficient between the recording medium and the outer peripheral surface is smaller than the friction coefficient between the recording medium and the discharging unit, and the friction coefficient between the recording medium and the inserting unit" is not limited to a configuration in which a material is used for the outer peripheral surface which makes a friction coefficient between the recording medium and the outer peripheral surface to be smaller than those of the discharging unit and the inserting unit with the recording medium. For example, the description also applies to a configuration in which a friction coefficient between the recording medium and the outer peripheral surface is made smaller than those of the discharging unit and the inserting unit with the recording medium by providing a mechanism that nips the recording medium to the discharging unit and the inserting unit.

In this case, the friction coefficient between the recording medium and the outer peripheral surface is smaller than the friction coefficient between the recording medium and the discharging unit, and the friction coefficient between the recording medium and the inserting unit. For this reason, since the friction coefficient between the recording medium and the outer peripheral surface is small, the recording medium is easily transported when the recording medium is pulled along the outer peripheral surface. In addition, the friction coefficient between the recording medium and the discharging unit, and the friction coefficient between the recording medium and the inserting unit are large, thereby making it possible to easily pull the recording medium along the outer peripheral surface, and to suppress deviation of the recording medium from the discharging unit and the inserting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
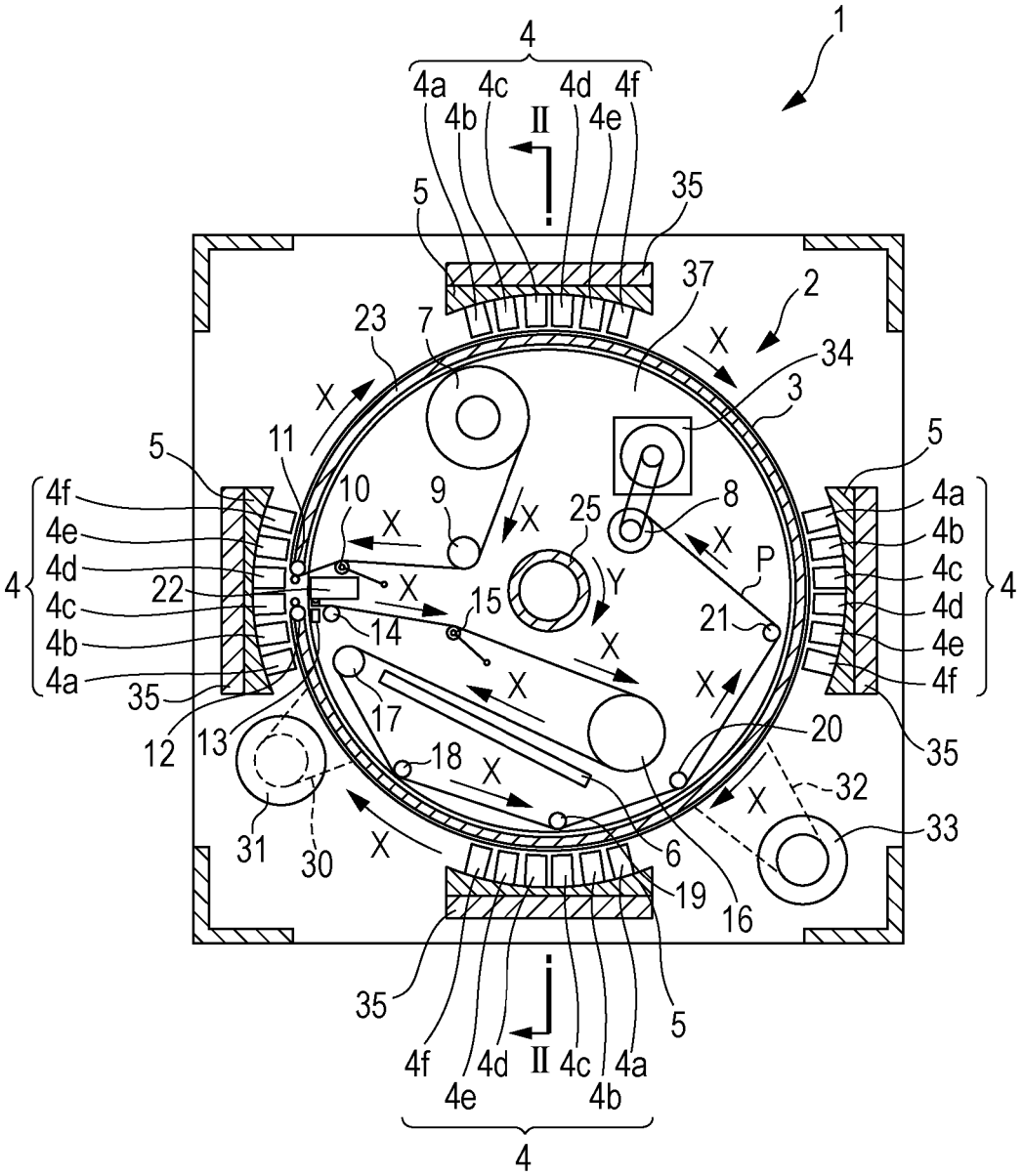
FIG. 1 is a schematic planar sectional view illustrating a recording apparatus according to Example 1 of the present invention.
Figure 2:
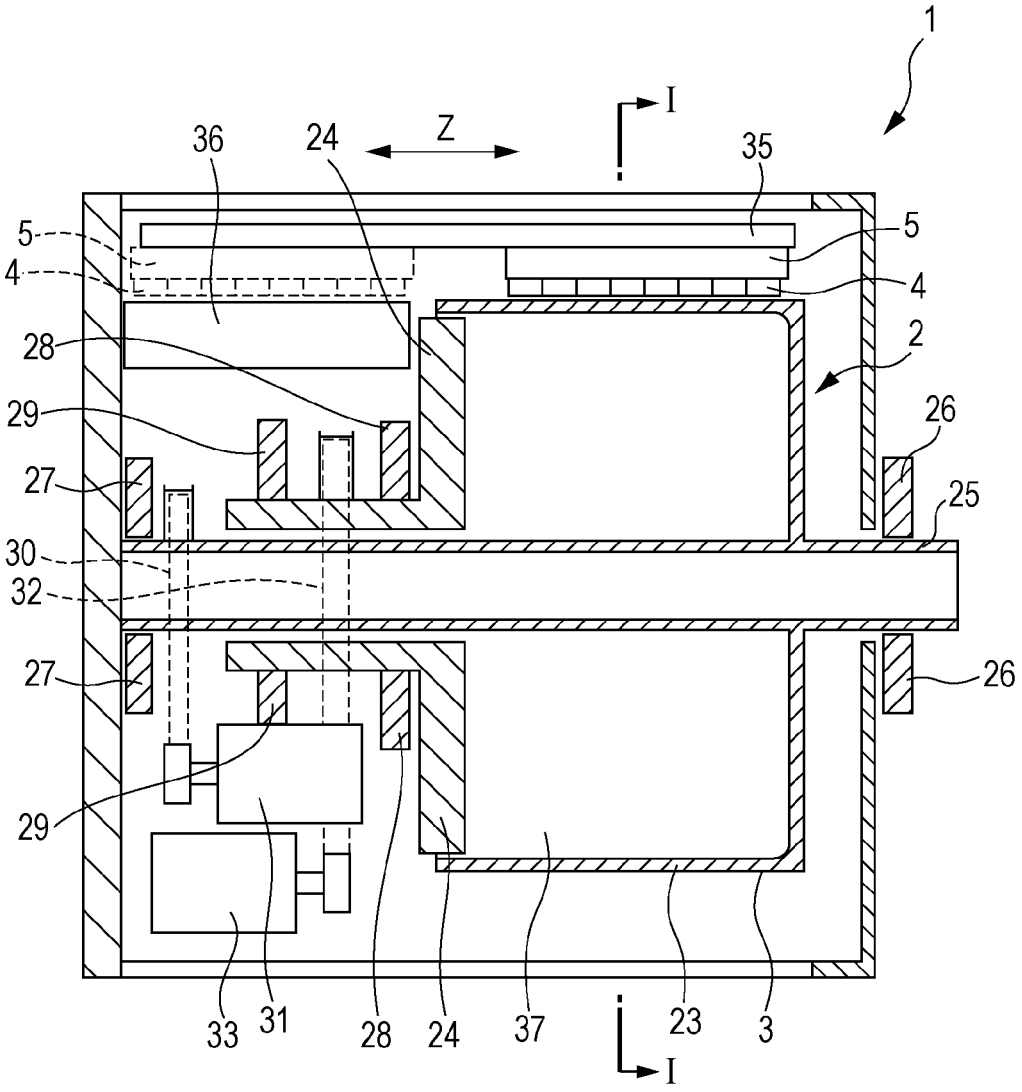
FIG. 2 is a schematic side sectional view illustrating the recording apparatus according to Example 1 of the invention.
Figure 3:
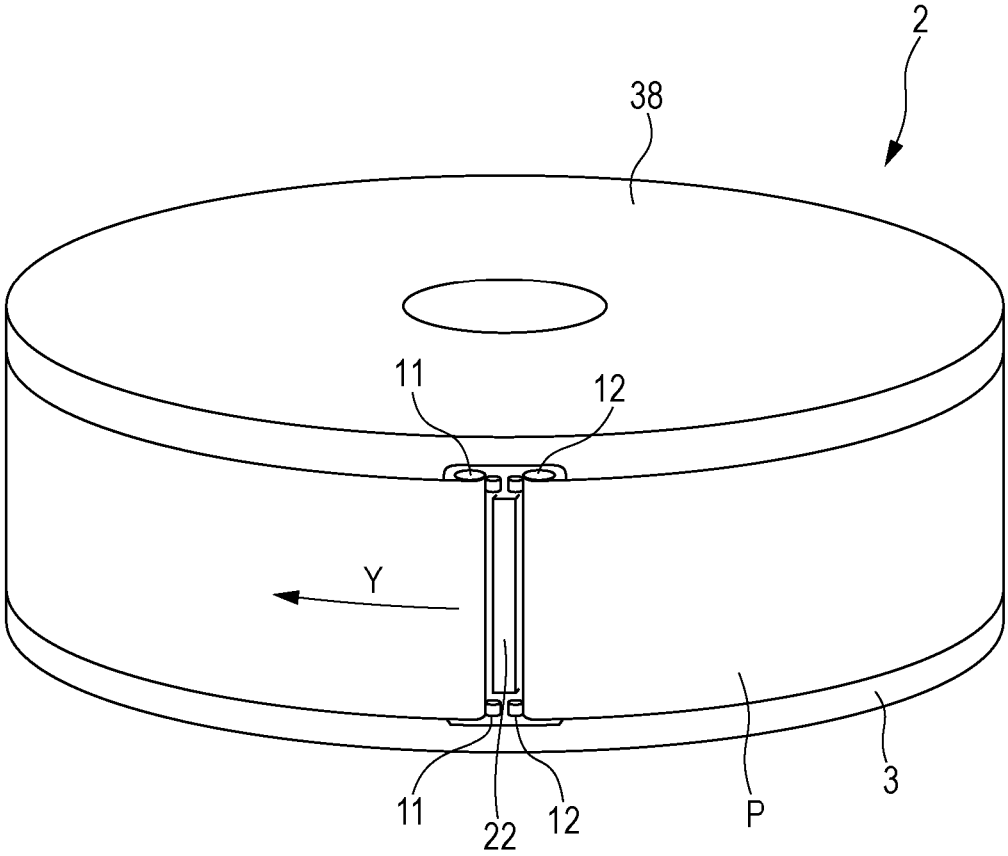
FIG. 3 is a schematic perspective view of a transport drum in the recording apparatus according to Example 1 of the invention.

Example 1, FIGS. 1 to 3

Hereinafter, a recording apparatus 1 according to an Example 1 of the present invention will be described in detail with reference to the accompanying drawings.

FIG. 1 is a schematic planar sectional view illustrating a recording apparatus 1 according to Example 1 of the invention. In addition, FIG. 2 is a schematic side sectional view illustrating the recording apparatus 1 according to Example 1 of the invention.

FIG. 2 is a cross-sectional view taken along dotted line II-II of FIG. 1, and FIG. 1 is a cross-sectional view taken along dotted line I-I of FIG. 2. In FIG. 2, in order to make a description of the recording apparatus 1 to be easily understood, the recording medium P and a configuration member of the inside 37 of the transport drum 2 are omitted.

In the recording apparatus 1 according to the example of the invention, the transport drum 2 that supports and transports the recording medium P on the outer peripheral surface 3 is included. In addition, a head unit 5 including recording heads 4 (from 4*a* to 4*f*) that eject ink onto the recording medium P is included at a position so as to be capable of facing the outer peripheral surface 3. Further, a heater 6, as a drying unit that dries ink ejected onto the recording medium P by the recording head 4, is included in the inside 37 of the transport drum 2.

The recording apparatus 1 according to the example of the invention allows the inside 37 of the transport drum 2 to be effectively used by such a configuration described above.

Since the recording head 4 is provided on the outside (a position capable of facing the outer peripheral surface 3) of the transport drum 2 and the heater 6 is included in the inside 37 of the transport drum 2 to dry the ink, a space of the recording head 4 which is provided on the outside of the transport drum 2 is isolated from a space of the heater 6 by an outer peripheral section 23 of the transport drum 2 (the detailed description is described later). Therefore, while an influence of heat from the heater 6 on the recording head 4 is suppressed, ink can be dried.

The recording heads 4*a* to 4*f* are recording heads that correspond to ink colors of black, cyan, magenta, yellow, light cyan, and light magenta used in the example of the invention, respectively. In the recording heads 4*a* to 4*f*, respectively, nozzles ejecting ink are arranged in plural in a Z direction of FIG. 2. In addition, in the recording heads 4*a* to 4*f*, respectively, a plurality of the nozzles are arranged in the Z direction to thereby configure so-called line heads, however, the invention is not limited to have such recording heads.

"The line head" is the recording head in which a region of the nozzle is formed in an intersection direction which is intersected with the transportation direction of the recording medium P so as to cover an entirety in the intersection direction of the recording medium P, and which is used in the recording apparatus in which an image is formed while fixing one of the recording head and the recording medium and moving the other of the recording head and the recording medium. The region of the nozzle in the intersection direction of the line head may not cover the entirety in the intersection direction of the whole recording medium P corresponding to the recording apparatus. In addition, both of the recording head and the recording medium may be movable, and either or both of the recording head and the recording medium may be moved to thereby form the image.

The recording apparatus 1 according to the example of the invention is configured based upon a premise that the elongated recording medium P capable of winding in a roll shape is used. However, the invention is not limited to the above described configuration, and as long as it is a configuration in which the transport drum 2 supporting and transporting the recording medium P on the outer peripheral surface 3, the recording head 4 provided on a position facing the outer peripheral surface 3 to eject ink onto the recording medium P, and the drying unit in the inside 37 of the transport drum 2 to dry the ink are included, a configuration that is capable of using a cut-sheet type recording medium P also may be used.

The recording apparatus 1 according to the example of the invention transports the recording medium P wound in a roll shape from a feeding roll 7 to a winding roll 8 by transporting the recording medium P in the transportation direction X.

In detail, the recording medium P fed from the feeding roll 7 is passed through a roller 9, a tensioner 10, a pair of outlet rollers 11, the outer peripheral surface 3, a pair of inlet rollers 12, a medium position sensor 13, a roller 14, a tensioner 15, a roller 16, and a roller 21 in sequence, and is wound on the winding roll 8.

The heater 6 is provided between the rollers 16 and 17 on a transportation path of the recording medium P so as to face a recording surface of the recording medium P onto which recording is performed by the recording head 4. The heater 6 is disposed in the inside of the transport drum 2, and, the heater 6 may be disposed so that ink is dried before the member appears which is in contact with the ink ejected onto the recording surface on the transportation path of the recording medium P after ink is ejected from the recording head 4 onto the recording surface of the recording medium P. Therefore, the heater 6 may be disposed on an upper stream side of the transportation path than the roller 16. In addition, as the heater 6, it is preferable that an infrared heater be used. The wavelength of the infrared heater is adjusted so as to be easily absorbed into components which are included in ink and need to be evaporated, thereby making it possible to efficiently dry.

In addition, the heater 6 is described as the drying unit, however, the invention is not limited to these configurations. A configuration which blows gas for drying the ink which is ejected onto the recording medium P may be used as the drying unit. According to the above described configuration, the components included in the evaporated ink are able to be blown off so that drying is further promoted.

The feeding roll 7 functions as a setting unit that sets the recording medium P.

The winding roll 8 functions as a winding unit that winds the recording medium P by driving power from a motor 34.

The pair of outlet rollers 11 functions as a discharging unit that discharges the recording medium P set on the feeding roll 7 to the outer peripheral surface 3.

The pair of inlet rollers 12 functions as the inserting unit that inserts the recording medium P discharged from the pair of outlet rollers 11 and transported along the outer peripheral surface 3 in the transportation direction X.

In other words, the recording medium P is an elongated recording medium capable of winding in a roll shape. The transport drum 2 according to the example of the invention includes, in the inside 37 thereof, the feeding roll 7 as the setting unit that sets the recording medium P, and the winding roll 8 as the winding unit that winds the recording medium P. The transport drum 2 according to the example of the invention includes, on the outer peripheral surface 3, the pair of outlet rollers 11 as the discharging unit that discharges the recording medium P set by the feeding roll 7 to the outer peripheral surface 3, and the pair of inlet rollers 12 as the inserting unit that inserts the recording medium P discharged from the pair of the outlet rollers 11 and transported along the outer peripheral surface 3. In the feeding roll 7 and the winding roll 8, the recording medium may be wound in a direction which is different from the illustrated direction. The roller in contact with the recording surface side of the pair of inlet rollers 12 presses the recording medium P on a position out of contact with ink ejected from the recording head 4.

In order to improve an image quality of a recording image, so-called a multipath recording, is generally performed in which the recording image is divided into multiple images. In the recording apparatus 1 including the transport drum 2 that supports and transports the elongated recording medium P on the outer peripheral surface 3, when recording the recording image by dividing the image into multiple images, it is efficient that the transport drum 2 is rotated multiple times and thus the recording is performed by dividing the image into multiple images. However, the recording apparatus 1 of the related art including the transport drum 2 that supports and transports the roll-shaped recording medium P on the outer peripheral surface 3, is not configured to have a configuration in which the transport drum 2 is rotated multiple times and thus the recording is performed by dividing the image into multiple images.

However, the transport drum 2 of the recording apparatus 1 according to the example of the invention is configured to be rotatable multiple times in a rotation direction Y in a state in which the recording medium P discharged from the pair of outlet rollers 11 and transported along the outer peripheral surface 3 is supported as it is (in a state in which the recording medium P is pulled along the outer peripheral surface 3 and a position thereof with respect to the outer peripheral surface is not changed). That is, in the recording apparatus 1 according to the example of the invention, since the transport drum 2 is rotated multiple times so that the predetermined position of the recording surface of the recording medium P supported on the outer peripheral surface 3 is opposite to the predetermined recording head multiple times, recording is performed by ejecting ink multiple times to the predetermined position of the recording surface of the recording medium P which is supported on the outer peripheral surface 3.

While rotating the transport drum 2 multiple times, in a case in which the recording is performed multiple times, the number of rotating of the transport drum 2 may not be same as the number of ejecting of the ink with respect to the predetermined position. For example, while rotating the transport drum 2 multiple times, ink may be ejected to the predetermined position once. According to the above described configuration, a time interval at the time of ejecting ink to the predetermined position multiple times can be extended. In addition, a time for fixing and drying the ink previously ejected to the recording medium P can be obtained, therefore, it is possible to reduce deterioration of the recording image due to the inks mixed with each other even in a case in which the ink is ejected to the predetermined position multiple times. In addition, while the transport drum 2 is rotated once, the ink may be ejected to the predetermined position multiple times from a plurality of the recording heads. According to the above described configuration, it is possible to reduce the time for recording on the recording medium P.

The recording apparatus 1 according to the example of the invention, includes a flushing box 22, as one of the maintenance units of the recording head 4, in a position capable of facing the recording head 4 between the pair of outlet rollers 11 and the pair of inlet rollers 12 on the outer peripheral surface 3.

"The maintenance unit of the recording head 4" is not particularly limited as long as the performance of the recording head 4 is maintained, and is the flushing box 22 in the example. Other configuration examples thereof include a wiping member, an absorption member, and the like.

By such a configuration, in the recording apparatus 1 according to the example of the invention, even in a state in which the recording medium P during recording, or the like, is pulled along the outer peripheral surface 3 (in a state of being supported), it is possible to maintain (flush) the recording head 4. In the recording apparatus 1 according to the example of the invention, a separate maintenance unit (a maintenance unit 36 in the example of the invention) may be included at a position other than a position between the pair of outlet rollers 11 and the pair of inlet rollers 12 on the outer peripheral surface 3. For example, a configuration may be used in which the recording head 4 is rotatable or movable and is capable of facing the maintenance unit being moved. Even in this case, it is preferable that at least the flushing box 22 be provided at a position so as to be capable of facing the recording head 4 between the pair of outlet rollers 11 and the pair of inlet rollers 12 whereby ink is ejected from the recording head 4 to the flushing box 22 and the ejecting state is adjusted when a recording is performed on the recording medium P while rotating the transport drum 2.

As illustrated in FIG. 2, the transport drum 2 according to the example of the invention includes an outer peripheral section 23 on which the outer peripheral surface 3 is formed and a base body section 24 which is provided as a separate body from the outer peripheral section 23 and is rotated with the outer peripheral section 23 while holding a member disposed in the inside 37 of the transport drum 2.

Since the outer peripheral section 23 (the outer peripheral surface 3) of the transport drum 2 is a support surface supporting the recording medium P, it is preferable to minimize an influence by a vibration due to the rotation of the transport drum 2 as much as possible. In the transport drum 2 according to the example of the invention, the base body section 24 is separately provided from the transport drum 2 and is rotated with the outer peripheral section 23. For this reason, the member which is disposed in the inside of the transport drum 2 is held in the base body section 24, thereby making it possible to lighten the weight of the transport drum 2. In addition, transferring vibration or the like generated from the member which is disposed in the inside, directly, to the transport drum 2 can be reduced. Accordingly, an influence of deviation and the vibration on the recording medium P which is supported on the outer peripheral surface 3 is suppressed, due to the rotation in a state in which the member in the inside of the transport drum 2 is not symmetric with respect to the rotating shaft. Further, the transport drum 2 can be rotated multiple times in a state in which the recording medium P discharged from the discharging unit (a pair of outlet rollers 11) and pulled along the outer peripheral surface 3 is supported as it is. That is, while the influence of the vibration or the like due to the rotation of the transport drum 2 is suppressed, the transport drum 2 can be rotated multiple times, and thus a recording can be performed multiple times on the recording medium P supported on the outer peripheral surface 3.

In the recording apparatus 1 according to the example of the invention, a rotating shaft 25 of the transport drum 2 extends in a vertical direction.

Here, "the vertical direction" is not limited to a vertical direction in a strict sense, and may also mean a direction which is slightly deviated from the vertical direction.

As the recording apparatus 1 according to the example of the invention, in the recording apparatus having a configuration in which the rotation shaft 25 of the transport drum 2 extends in a vertical direction, the inside 37 of the transport drum 2 can be effectively used, and the ink can be dried while suppressing the influence of the drying unit (heater 6) on the recording head 4. In addition, when the rotation shaft 25 of the transport drum 2 extends in a vertical direction, the bottom surfaces are positioned in an up-down direction. Therefore, when at least an upper bottom surface is in an open state, the heat, which is generated from the drying unit (heater 6) disposed in the inside of the transport drum 2 or from other members is suppressed from remaining, in the inside of the transport drum 2.

However, the invention is not limited to the above described configuration, and for example, the rotating shaft 25 of the transport drum 2 may extend in a horizontal direction.

As illustrated in FIG. 2, in the recording apparatus 1 according to the example of the invention, the rotating shaft 25 is integrally formed with the outer peripheral section 23 and is supported by outer peripheral section bearings 26 and 27. In addition, the base body section 24 is supported by base body section bearings 28 and 29, and is provided so as to be capable of rotating with respect to the rotating shaft 25.

The outer peripheral section 23 is rotated in the rotation direction Y by transferring driving power generated from a motor 31 through a belt 30. In addition, the base body section 24 is rotated in a rotation direction Y by transferring a driving power generated from a motor 33 through a belt 32.

As illustrated in FIG. 2, in the recording apparatus 1 according to the example of the invention, the head unit 5 can be moved in a direction Z, from the position where the recording is performed to a home position facing the maintenance unit 36 along a rail 35.

Here, the maintenance unit 36, in order to maintain the performance of the recording head 4, performs capping, cleaning, or the like, on the recording head 4.

In the recording apparatus 1 according to the example of the invention, a friction coefficient between the recording medium P and the outer peripheral surface 3 is smaller than a friction coefficient between the recording medium P and the discharging unit (a pair of outlet rollers 11), and a friction coefficient between the recording medium P and the inserting unit (a pair of inlet rollers 12).

Here, "the friction coefficient between the recording medium P and the outer peripheral surface 3 is smaller than the friction coefficient between the recording medium P and the discharging unit, and the friction coefficient between the recording medium P and the inserting unit" is not limited to a configuration in which a material is used for the outer peripheral surface 3 which makes a friction coefficient between the recording medium P and the outer peripheral surface 3 to be smaller than those of the discharging unit and the inserting unit with the recording medium P. For example, as the recording apparatus 1 according to the example of the invention, the description also applies to a configuration in which a friction coefficient between the recording medium P and the outer peripheral surface 3 is made smaller than those of the discharging unit and the inserting unit with the recording medium P by providing a mechanism that nips the recording medium P to the discharging unit and the inserting unit.

In the recording apparatus 1 according to the example of the invention, by the above described configuration, since the friction coefficient between the recording medium P and the outer peripheral surface 3 is small, thereby making it possible to easily transport the recording medium P when the recording medium P is pulled along the outer peripheral surface. Since the friction coefficient between the recording medium P and the pair of outlet rollers 11, and the friction coefficient between the recording medium P and the pair of inlet rollers 12 are large, the recording medium P pulled along the outer peripheral surface 3 can be supported so as not to be deviated.

Next, the transport drum 2 according to the example of the invention will be described in more detail.

FIG. 3 is a schematic perspective view of the transport drum 2 according to the example of the invention.

As illustrated in FIG. 3, in the transport drum 2 according to the example of the invention, a cover 38 can be attached on the upper portion, thereby making it possible to blind the inside 37 of the transport drum 2.

Figure 4:
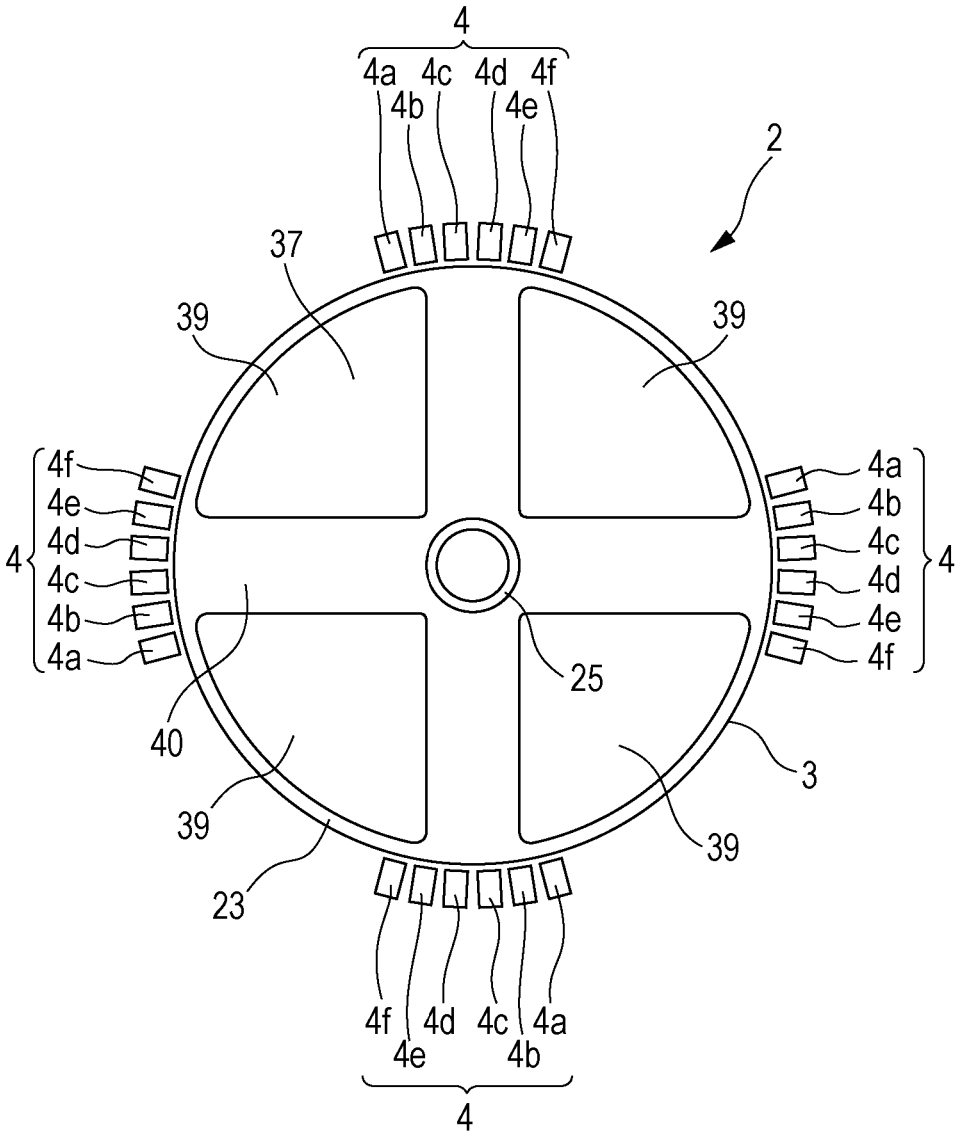
FIG. 4 is a schematic plan view illustrating a transport drum in a recording apparatus according to Example 2 of the invention.

Example 2, FIG. 4

Next, a recording apparatus according to Example 2 will be described in detail with reference to the accompanying drawings.

FIG. 4 is a schematic plan view illustrating a transport drum 2 according to the Example 2. In addition, like numbers reference like components which are the same as the above example, and the detailed description thereof will be omitted.

A recording apparatus 1 according to the example of the invention is configured to have the same configuration as the recording apparatus 1 of the Example 1 except for the configuration in which a cover 40 is provided with a hole 39 to upper portion of the transport drum 2, instead of the cover 38 which is attached to blind the inside 37 of the transport drum 2.

In addition, as illustrated in FIG. 4, in the cover 40 on the upper portion of the transport drum 2 according to the example of the invention, the hole 39 is provided so as to open on a part thereof to the outside. For this reason, steam of ink generated from the heater 6 can be efficiently released to the outside, thereby making it possible to improve a drying efficiency of the ink.

Therefore, as the recording apparatus 1 according to the example of the invention, it is preferable that a configuration be used in which at least a part of at least one of the bottom surfaces of the transport drum 2 is opened to the outside.

The entire disclosure of Japanese Patent Application No. 2013-239670, filed Nov. 20, 2013 is expressly incorporated by reference herein.

What is claimed is:

1. A recording apparatus comprising:

a transport drum that supports and transports a recording medium on an outer peripheral surface thereof;

a recording head that is provided in a position so as to be capable of facing the outer peripheral surface and ejects ink onto the recording medium; and a drying unit that is provided in the inside of the transport drum so as to face a recording surface of the recording medium and dries the ink.

2. The recording apparatus according to claim 1, wherein the recording medium is a recording medium capable of being wound in a roll shape, and the transport drum includes, in the inside thereof, a setting unit that sets the recording medium and a winding unit that winds the recording medium, and on the outer peripheral surface thereof, a discharging unit that discharges the recording medium set by the setting unit to the outer peripheral surface, and an inserting unit that inserts the recording medium discharged by the discharging unit and transported along the outer peripheral surface.

3. The recording apparatus according to claim 1, wherein at least a part of at least one of bottom surfaces of the transport drum is opened to the outside.

4. The recording apparatus according to claim 2, further comprising:

a maintenance unit of the recording head at a position so as to be capable of facing the recording head between the discharging unit and the inserting unit on the outer peripheral surface.

5. The recording apparatus according to claim 1, further comprising:

a base body section that is separately provided from the transport drum, holds a member disposed in the inside of the transport drum and is rotated with the transport drum.

6. The recording apparatus according to claim 1, wherein a rotating shaft of the transport drum extends in a vertical direction.

7. The recording apparatus according to claim 2 wherein a friction coefficient between the recording medium and the outer peripheral surface is smaller than a friction coefficient between the recording medium and the discharging unit, and a friction coefficient between the recording medium and the inserting unit.

* * * * *